US006954992B2

(12) United States Patent
Hwang

(10) Patent No.: US 6,954,992 B2
(45) Date of Patent: Oct. 18, 2005

(54) DRYER

(75) Inventor: Sung Gi Hwang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/720,394

(22) Filed: Nov. 25, 2003

(65) Prior Publication Data

US 2004/0107598 A1 Jun. 10, 2004

(30) Foreign Application Priority Data

Nov. 28, 2002 (KR) ..... P10-2002-0075012

(51) Int. Cl.[7] ..... D06F 58/00; F26B 11/02
(52) U.S. Cl. ..... 34/108; 34/603
(58) Field of Search ..... 34/108, 601, 602, 34/603; 292/121, 17, DIG. 69

(56) References Cited

U.S. PATENT DOCUMENTS 3,261,628 A * 7/1966 Kesling ..... 292/70
3,520,568 A * 7/1970 White et al. ..... 292/255
3,674,295 A * 7/1972 Padovani ..... 292/76
4,272,111 A * 6/1981 Hammer et al. ..... 292/17
5,062,668 A * 11/1991 Onderka et al. ..... 292/25
5,243,771 A * 9/1993 Kretchman et al. ..... 34/108

* cited by examiner

*Primary Examiner*—Kenneth Rinehart
(74) *Attorney, Agent, or Firm*—Fleshner & Kim LLP

(57) ABSTRACT

Disclosed is an apparatus for opening/closing a door of a dryer, by which the door is opened/closed more simply and swiftly. The present invention includes a housing, a drum rotatably installed in the housing, a heating apparatus for supplying hot air to the drum, a door opening/closing an entrance formed at the housing for putting a laundry in the drum, and an apparatus for opening/closing the door. And, the apparatus for opening/closing the door includes a hook provided at one side of the door of the dryer, the hook having a hanging portion formed at one end to have an incline surface, a latch body provided to the housing in the vicinity of the entrance wherein the hanging portion is inserted the latch body, a pair of holders provided to confront each other in the latch body to hold the hanging portion, a pair of springs provided in rear of the holders, respectively.

31 Claims, 7 Drawing Sheets

DRYER

This application claims the benefit of Korean Application (s) No. 10-2002-0075012 filed on Nov. 28, 2002 which is/are hereby incorporated by reference.

BACKGROUND OF THE INVENTION

1. Field of the Invention

The present invention relates to a dryer, and more particularly, to an apparatus for opening/closing a door of a dryer.

2. Discussion of the Related Art

Generally, a dryer is an apparatus for drying a washed laundry quickly using hot air. Lately, a washing machine equipped with a drying function has been developed as well.

FIG. 1 is a perspective view of a dryer according to a related art.

Referring to FIG. 1, a dryer according to a related art consists of a case 2, a drum 4, a heater (not shown in the drawing), and a motor (not shown in the drawing).

An opening 2*a* via which a laundry is put in or pulled out of the drum 4 is formed at a front side of the case 2. The drum 4 is rotatably installed in the case 2 to communicate with the opening 2*a*. A plurality of lifters 3 protrude from an inner conference of the drum 4 to lift the laundry in the drum 4 to fall.

The heater (not shown in the drawing) generating hot air for drying the laundry and the motor (not shown in the drawing) for rotating the drum 4 are installed outside the drum 4.

The case 2 consists of a cabinet 32, a front panel 33, a top cover 35, and a control panel 36.

The front panel 33 having the opening 2*a* formed at its front side is provided to a front side of the cabinet 32. The top cover 35 is provided to a top of the cabinet 32. The control panel 36 is provided on a rear top of the top cover 35. And, electronic units for controlling the dryer are installed in the control panel 36.

Meanwhile, a door 10 is provided at one side of the opening 2*a* in the front panel 33 to open/close the opening 2*a*.

The door 10 consists of a hook 30 and a latch assembly 34. The hook 30 is fixed to one side of the door 10 using screws 31, and the latch assembly 34 is fixed to one side of the front panel 33 using screws 34*a*. And, the door 10 is provided to a hinge 12 fixed to the front panel 33 in the vicinity of the opening 2*a* to revolve centering around the hinge 12.

The latch assembly 34 locks or unlocks the hook 30 installed at the door 10 according to a signal of a control unit. In this case, a user freely enables to open/close the door 10 while power is not applied to a door lock switch separately installed at one side of the dryer.

Meanwhile, while the door 10 is closed and the power is applied to the door lock switch, the latch assembly 34 keeps locking the hook 30 so that the door 10 is unable to be opened.

However, the related art dryer has the following problem or disadvantage.

First of all, the dryer differs from a washing machine in that water is not held in the dryer. Hence, the user needs to open the door in order to put more dry objects in the dryer in progress or in order to check a drying state of the laundry while the dryer operates. In this case, the structure of the apparatus for opening/closing the door of the dryer is equal or similar to that of the washing machine. Hence, it is inconvenient or takes pains to open/close the door.

SUMMARY OF THE INVENTION

Accordingly, the present invention is directed to a dryer that substantially obviates one or more of the problems due to limitations and disadvantages of the related at.

An object of the present invention, which has been devised to solve the foregoing problem, lies in providing a dryer equipped with a door that can be opened/closed more simply and swiftly.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a dryer including a housing, a drum rotatably installed in the housing, a heating apparatus for supplying hot air to the drum, a door opening/closing an entrance formed at the housing for putting a laundry in the drum, and an apparatus for opening/closing the door. And, the apparatus for opening/closing the door includes a hook provided at one side of the door of the dryer, the hook having a hanging portion formed at one end to have an incline surface, a latch body provided to the housing in the vicinity of the entrance wherein the hanging portion is inserted the latch body, a pair of holders provided to confront each other in the latch body to hold the hanging portion, a pair of springs provided in rear of the holders, respectively.

In this case, the latch body includes a first reception part receiving the hanging portion and a pair of second reception parts provided adjacent to both sides of the first reception part to hold to guide the holders, respectively. And, a pair of passing holes communicating with the second reception parts are formed at both of the sides of the first reception part to let the holders pass through, respectively.

Moreover, a recess is formed at one end of each of the second reception parts to support the corresponding spring. And, a hanging protrusion is formed on one side of each of the holders to be held by an upper end of the first reception part.

Meanwhile, the hanging portion has a triangular cross-section. In this case, confronting planes of the holders are inclined to correspond to the triangular cross-section of the hanging portion.

A surface of the hanging portion to be brought contact with the holders is rounded, and two confronting tips of the holders are rounded.

Moreover, a hollow portion is provided at a rear side of each of the holders to have one end of the corresponding spring inserted therein.

Meanwhile, the dryer further includes a latch cap covering the first and second reception parts to prevent separation of the holders and the springs.

In this case, fixing protrusions protrude from a bottom of the latch cap to hold one ends of the springs, respectively and guide protrusions protrude from a bottom of the latch cap to guide to move the holders, respectively.

Moreover, coupling holes are formed at corners of the latch cap and wherein bolts are screwed in the coupling holes, respectively to fix the latch cap to the latch body. And, the hook is built in one body of a fixing plate screw-coupled to one side of the door.

Coupling holes are formed at both sides of the latch body and wherein bolts are screwed in the coupling holes, respectively to fix the latch body to the front panel.

Preferably, the incline surface of the hook guides insertion and separation of the hanging portion. More preferably, the incline surface is provided to open a gap between the holders and substantially to push the holders backward.

Specifically, the incline surface includes a first incline surface opening a space between the holders to guide an insertion of the hanging portion therein. And, the first incline surface is formed at a front side of the hanging portion. Moreover, the incline surface comprises a second incline surface opening a space between the holders to guide a retreat of the hanging portion. And, the second incline surface is formed at a rear side of the hanging portion. Preferably, the incline surface further includes an intermediate portion between the first and second incline surfaces to maintain a hanging state of the hanging portion.

Preferably, an incline angle of the first incline surface is smaller than that of the second incline surface.

Moreover, at least one rib is provided to the hook to reinforce strength thereof.

Therefore, the present invention facilitates to open/close the door, thereby enabling to provide a user with convenience of use.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
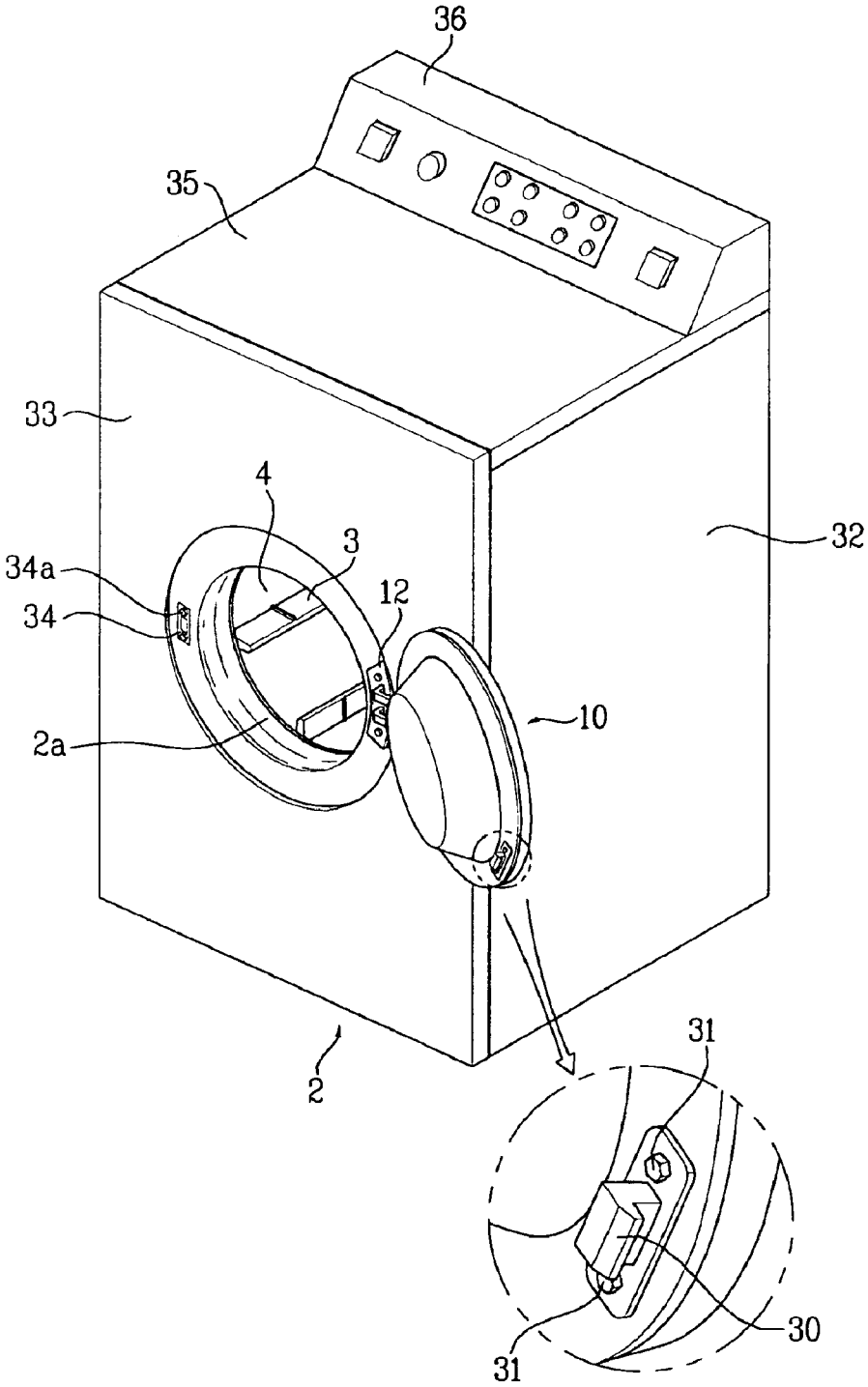
FIG. 1 Prior Art
FIG. 1 is a perspective view of a dryer according to a related art.
Figure 2:
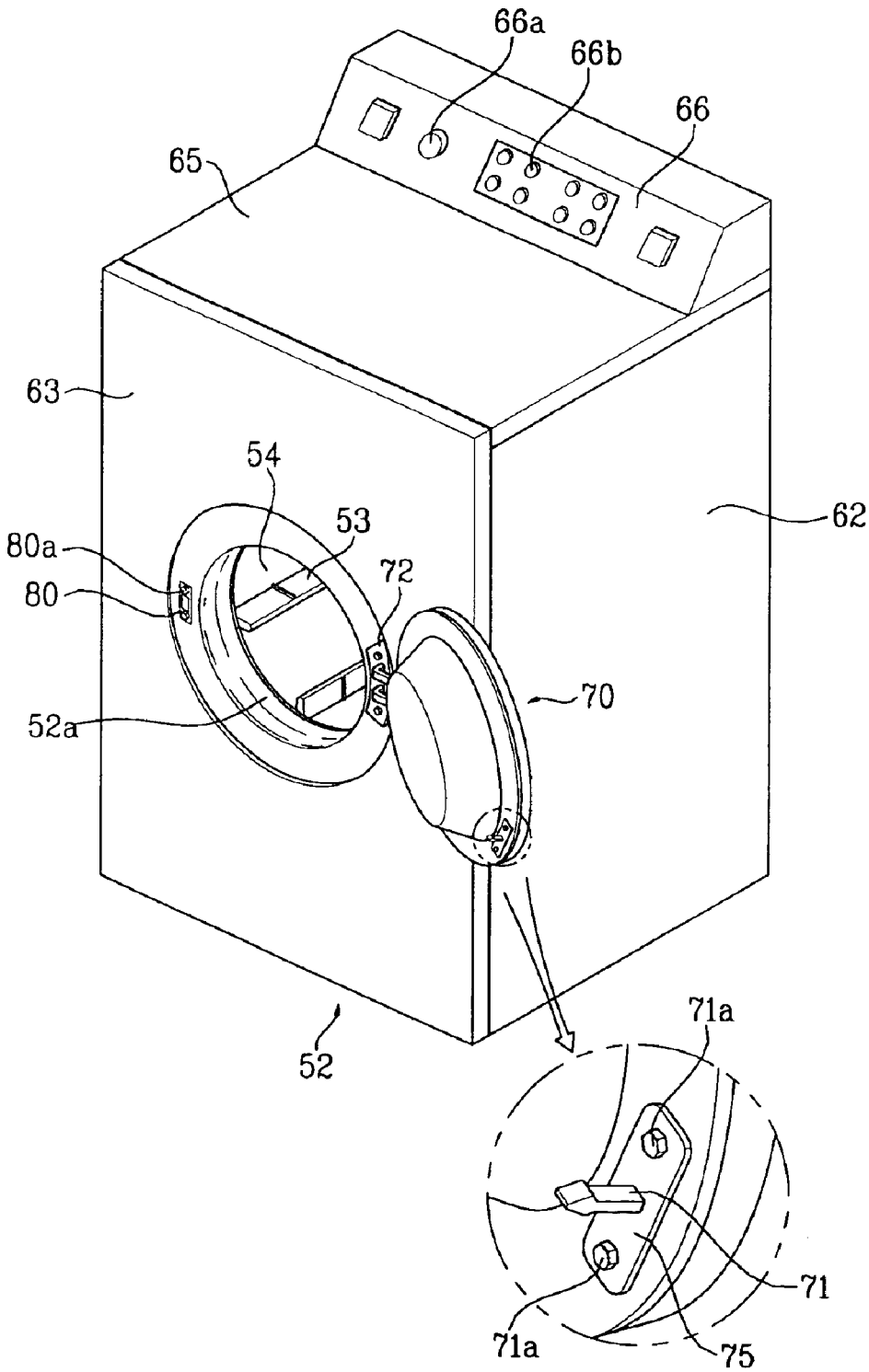
FIG. 2 is a perspective view of a dryer according to the present invention.

FIG. 2 is a perspective view of a dryer according to one embodiment of the present invention.

Referring to FIG. 2, a dryer according to one embodiment of the present invention includes a case 52, a drum 54, a heater (not shown in the drawing), a motor (not shown in the drawing), and a door 70.

An opening 52*a* is formed at a front side of the case 52. The drum 54 is provided in the case 52 to hold a laundry inside. A plurality of lifters 53 are provided to protrude from an inner circumference of the drum 54 to lift the laundry in the drum 54 to fall. The heater generating dry hot air for drying the laundry is provided outside the drum 54. And, the dry hot air is blown into the drum 54 by a fan (not shown in the drawing). The motor (not shown in the drawing) for rotating the drum 4 is provided outside the drum 54 to rotate the drum 54.

The case 52 includes a cabinet 62, a front panel 63, a top cover 65, and a control panel 66.

The front panel 63 having the opening 52*a* formed at its center is provided to a front side of the cabinet 62. The top cover 65 is provided to a top of the cabinet 62. The control panel 66 is provided on a rear top of the top cover 65. An operation control unit 66*a* for controlling an operation of the dryer and an operation display unit 66*b* are installed on a front side of the control panel 66, and electronic units for controlling the dryer are loaded in the control panel 66.

Meanwhile, the door 70 is provided at one side of the opening 52*a* in the front panel 63 to open/close the opening 52*a*. And, the door 70 is provided to a hinge 72 fixed to the front panel 63 in the vicinity of the opening 52*a* to revolve centering around the hinge 72.

Figure 3:
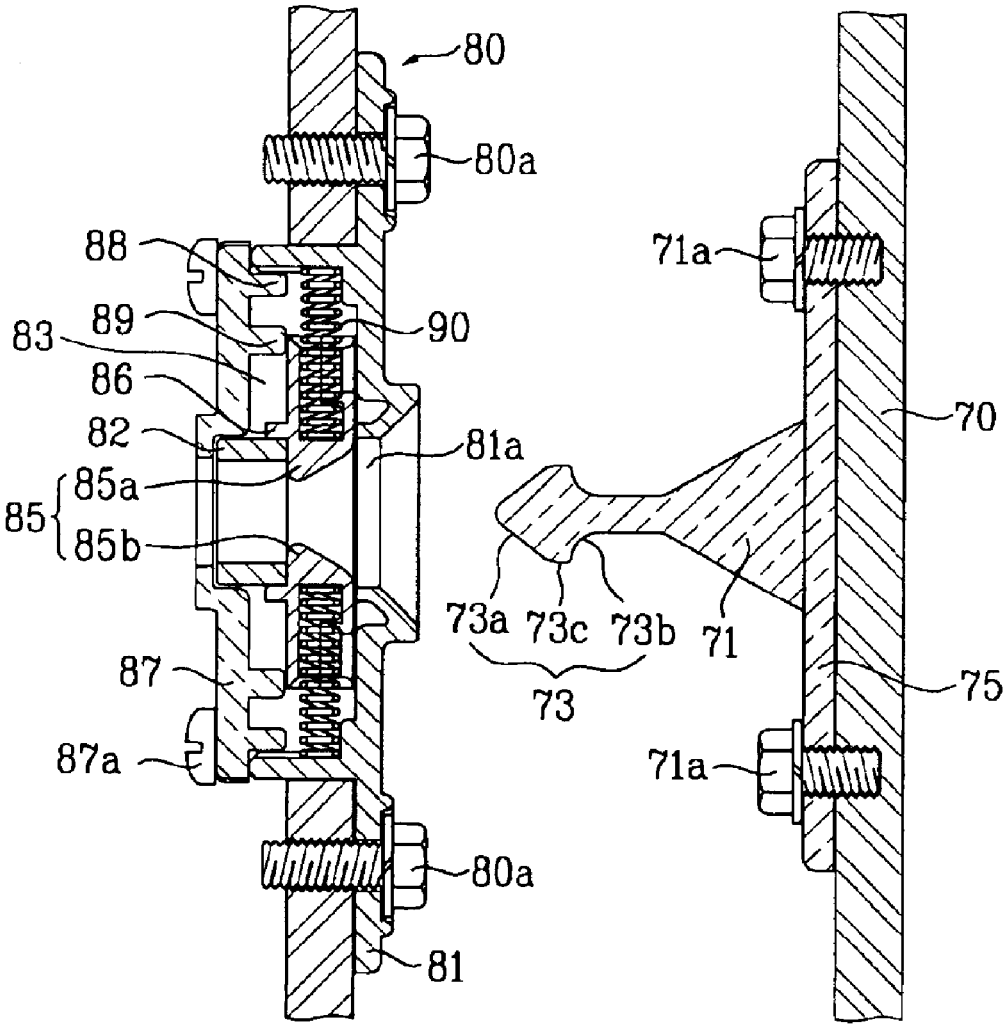
FIG. 3 is a cross-sectional view of an apparatus for opening/closing a door of a dryer according to the present invention.

FIG. 3 is a cross-sectional view of an apparatus for opening/closing a door according to the present invention.

Referring to FIG. 3, the door 70 includes a hook 71 having a hanging portion 73 and a latch assembly 80.

The hook 71 is formed to protrude from a fixing plate 75 fixed to the door 70. The fixing plate 75 is fixed to a portion of the door 70 opposite to the other portion coupled to the hinge 63 using bolts 71*a*. And, the hanging portion 73 having a triangular cross-section is formed at one end of the hook 71.

Moreover, the latch assembly 80 for catching or releasing the hook 71 thereon is fixed to the front panel 63 using bolts 80*a*.

The latch assembly 80 includes a latch body 81, a holder 85, a pair of springs 90, and a latch cap 87.

The latch body 81 includes an insertion hole 81*a* in which the hook 71 is inserted. The holder 85 is provided with a pair confronting each other in the latch body 81, and two confronting one ends of the holder 85 are slant to form incline planes, respectively. The hanging portion 73 of the hook 71 is inserted in the latch body 81 by sliding in along the incline planes so as to be held by the holder 85. A pair of the springs 90 are provided to the other ends of the holder 85, respectively. The springs 90 are elastically compressed when the hanging portion 73 is inserted, whereby the holder 85 moves backward. If an external force applied to the holder 85 is released, the springs 90 return the holder 85 back to its original position. And, the latch cap 87 is coupled to a rear side of the latch body 81 to prevent the separation of the holder 85 and the springs 90.

A coupling mechanism between the hook 71 and the latch assembly 80 is explained in detail as follows.

First of all, the hanging portion 73 protruding triangularly is provided to the tip of the hook 71, and the incline planes provided to the one ends of the holder 85 correspond to an incline plane of the hanging portion 73.

Figure 8A:
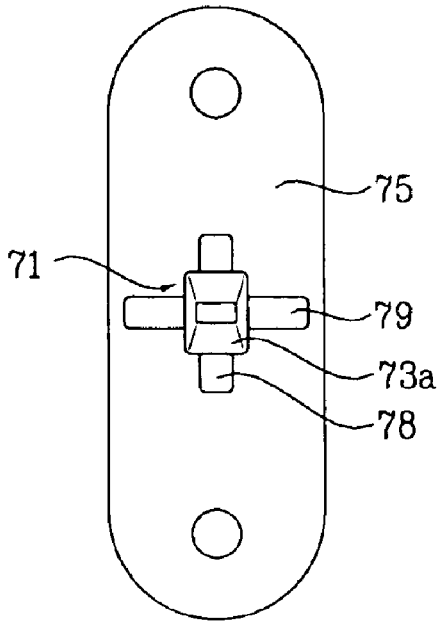
FIG. 8A and FIG. 8B are a layout and a cross-sectional view of a hook according to the present invention.
Figure 8B:
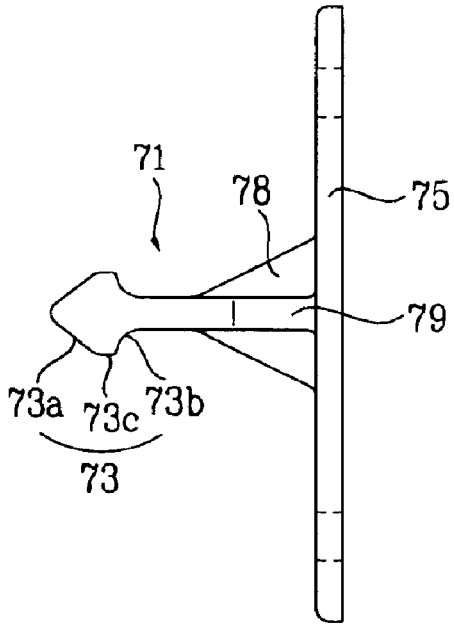

The hanging portion 73 of the hook 71, as shown in FIG. 3, FIG. 8A, and FIG. 8B, has an incline surface slant at a predetermined angle. The incline surface guides the insertion of the hook 71 into the latch body 81 and the separation of the hook 71 from the latch body 81. Specifically, the incline surface basically includes a first incline surface 73*a* formed at a front side of the hanging portion 73. The first incline surface 73*a* comes into contact with the first and second holders 85*a* and 85*b* to open a space between them. Namely, a gap between the first and second holders 85*a* and 85*b* is widened. Hence, the hanging portion 73 is guided to enter the latch body 81 by the first incline surface 73*a*. Moreover, a second incline surface 73*b* is further formed at a rear side of the hanging portion 73. When the door 70 is pulled, the second incline surface 73*b* pushes back the first and second holders 85*a* and 85*b* to guide the hanging portion 73 to retreat. In this case, the first incline surface 73*a* is preferably formed to have an incline angle smaller than that of the second incline surface 73*b*. A difference between the incline angles facilitates to close the door 70 with a less force. In contrast, the second incline surface 73*b* having the relatively greater incline angle interrupts to open the door 70, whereby the door 70 is opened by a force relatively greater than a force needed to close the door 70. Besides, the door 70 is not opened by a vibration generated from operating the dryer or other external forces. Preferably, an intermediate portion 73*c* is formed between the first and second incline surfaces 73*a* and 73*b* to assist the hanging portion 73 to keep being caught on the holder 85 in order not to open the door 70 with ease. As explained in the foregoing description, the incline surfaces 73*a* and 73*b* widen the gap between the first and second holders 85*a* and 85*b*. More specifically, the incline surfaces 73*a* and 73*b* push the first and second holders 85*a* and 85*b* backward to expand the space or gap between them. Hence, the hanging portion 73 is smoothly inserted in or separated from the latch body 81. Besides, at least one or more ribs, as shown in FIG. 8A and FIG. 8B, are provided to the hook 71. Specifically, vertical and horizontal ribs 78 and 79 extend between the hook 71 and the fixing plate 75, thereby substantially reinforcing strength of the hook 71.

The holder 85, as shown in FIG. 3, includes the first and second holders 85*a* and 85*b* provided at both sides of the latch body 81 to confront each other.

Figure 5:
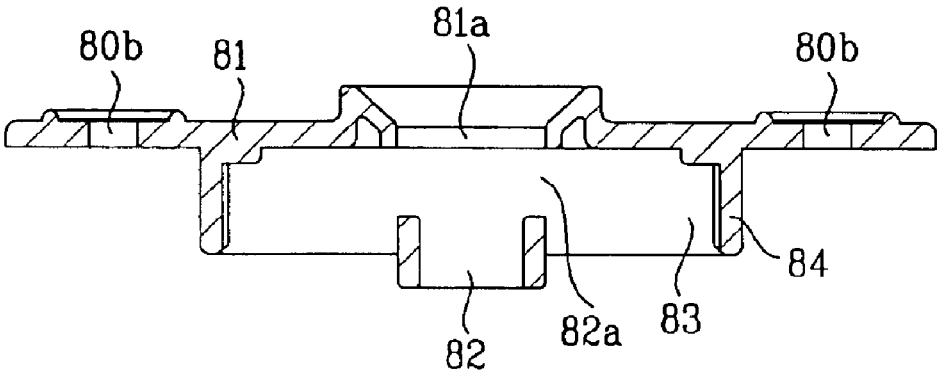
FIG. 5 is a cross-sectional view of a latch body of a latch assembly according to the present invention.
Figure 6:
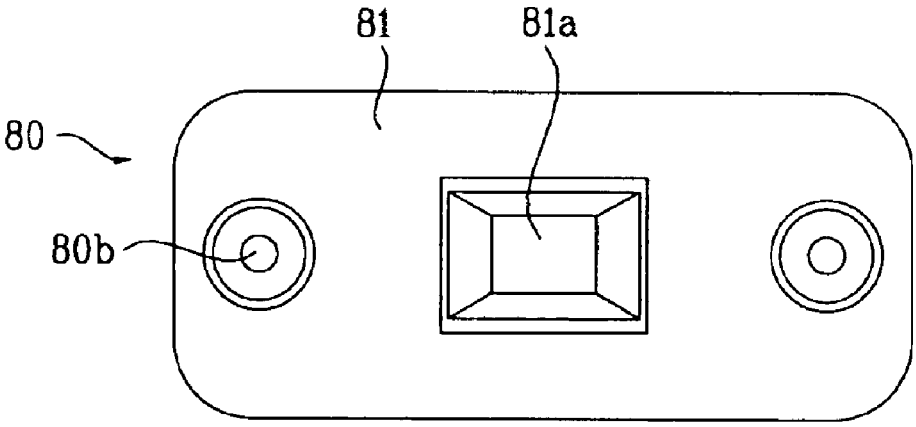
FIG. 6 is a layout of a latch assembly according to the present invention.

When the door 70 is closed, the hanging portion 73 of the hook 71 is inserted in the latch body 81 via the insertion hole 81*a*. Another incline plane, as shown in FIG. 3, FIG. 5, and FIG. 6, is formed inward in the insertion hole 81*a* to lead the hanging portion 73 to the latch body 81 smoothly. The hanging portion 73 is inserted to slide along the incline planes of the first and second holders 85*a* and 85*b*. In this case, the first and second holders 85*a* and 85*b* move backward as the springs 90 are elastically compressed by the insertion of the hanging portion 73. Once such an insertion is completed, the springs 90 return to original positions, respectively, and a rear end of the hanging portion 73 is caught on the first and second holders 85*a* and 85*b*. Hence, the hook 71 is fixed to the latch assembly 80 so that the door 70 maintains to be closed.

Moreover, tips of the holder 85 are rounded, and the second incline surface 73*b* of the hanging portion 73 brought contacted with the tips of the holder 85 to be held is rounded as well. Hence, if the door 70 is pulled by a certain force, the springs 90 are compressed to move backward the holder 85 guided by the second incline surface 73*b* so that the user enables to open the door 70 conveniently.

Figure 4:
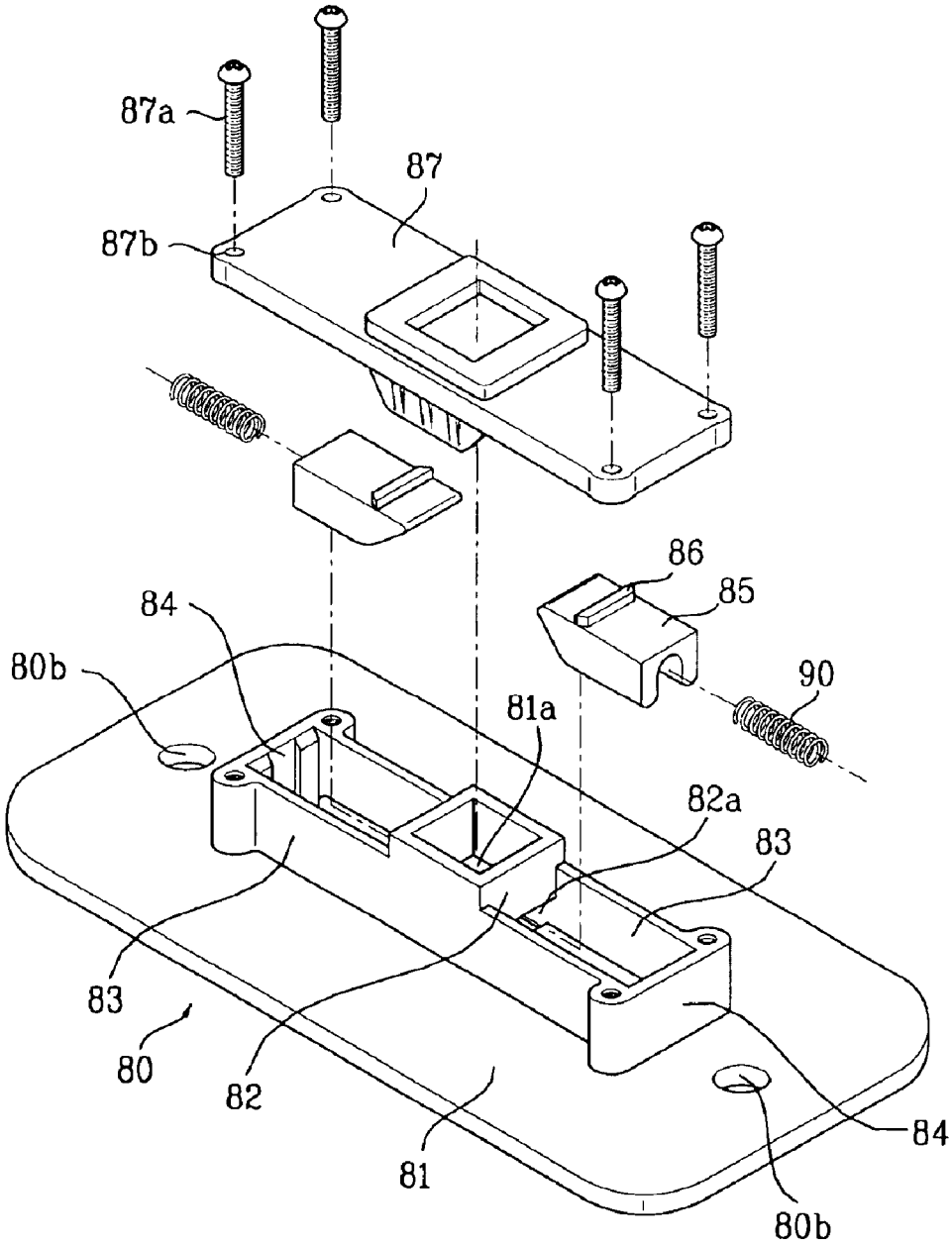
FIG. 4 is a perspective view of a disassembled latch assembly according to the present invention.

FIG. 4 is a perspective view of a disassembled latch assembly according to the present invention and FIG. 5 is a cross-sectional view of a latch assembly according to the present invention.

Referring to FIG. 4 and FIG. 5, a rectangular first reception part 82 is formed on a central portion of the latch body 81, and the hook 71 is inserted in the first reception part 82. A pair of passing holes 82*a* are formed at both sides of the first reception part 82 to communicate with a pair f second reception parts 83, respectively. The second reception parts 83 are provided adjacent to both sides of the first reception part 82, respectively to hold and guide the holder 85. Hence, the holder 85 enables to reciprocate between the first and second reception parts 82 and 83 through the passing holes 82*a*.

A support 84 is formed at an end of each of the second reception parts 83 to support one end of the corresponding spring 90. A center of the support 84 is recessed to provide a step so that a loaded location of the corresponding spring 90 is fixed thereto, whereby the corresponding spring 90 loaded in the latch body 81 is prevented from fluctuating.

Each portion of the holder 85 to be brought contact with the hanging portion 73 is formed slant to correspond to the hanging portion 73. Hence, once the hanging portion 73 of the hook 71 is inserted, the gap between the first and second holders 85*a* and 85*b* is easily widened by the elastic deformation of the springs 90. And, a hollow portion is formed inside each of the first and second holders 85*a* and 85*b* to have one end of the corresponding spring 90 inserted therein.

Referring to FIG. 3 and FIG. 4, a hanging protrusion 86 formed at one side of each of the first and second holders 85*a* and 85*b* is held by one corresponding side of the first reception part 82, whereby a predetermined gap is always maintained between the first and second holders 85*a* and 85*b*. Hence, the hanging portion 73 of the hook 71 is inserted in the gap to be fixed thereto.

A pair of fixing protrusions 88 protrude from a bottom of the latch cap 87 to hold one ends of the springs 90, respectively. The fixing protrusions 88 fix the springs 90 not to be separated from the second reception parts 83, respectively.

Moreover, the latch cap 87 is provided to leave a predetermined distance from the holder 85. A pair of guide protrusions 89 protruding from the bottom of the latch cap 87 are brought contact with the one corresponding sides of first and second holders 85*a* and 85*b* to guide the holder 85 to slide in and out.

An exterior of the latch assembly 80 is explained as follows.

Figure 7:
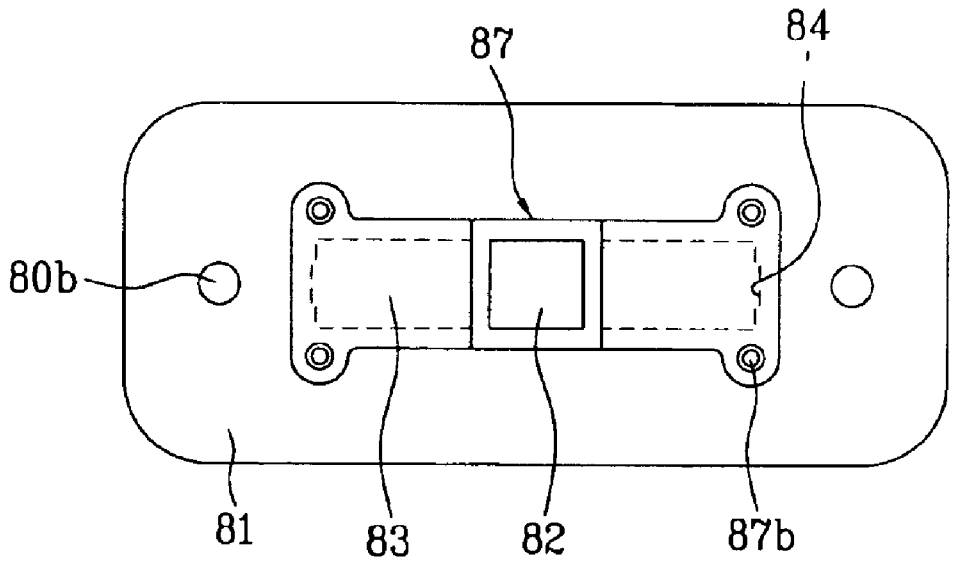
FIG. 7 is a rear view of a latch assembly according to the present invention.

FIG. 6 is a layout of a latch assembly according to the present invention and FIG. 7 is s a rear view of a latch assembly according to the present invention.

Referring to FIG. 6, the insertion 81*a* is formed in the latch body 81 provided on the front side of the latch assembly 80. The hanging portion 73 of the hook 71 is inserted through the insertion hole 81*a*. Moreover, bolt coupling holes 80*b* are formed at both ends of the latch body 81. Bolts are screwed in the bolt coupling holes 80*b* so that the latch body 81 is fixed to the front panel 63 in the vicinity of the opening 52*a*.

Referring to FIG. 7, the first reception part 82 and a pair of the second reception parts 83 protrude from a rear side of the latch body 81, and the first and second reception parts 82 and 83 are covered with the latch cap 87. Hence, one side of the front panel 63 where the latch assembly 80 is installed is partially recessed inward to correspond to protruding portions of the first and second reception parts 82 and 83.

An operation of the apparatus for opening/closing the door of the dryer according to the present invention is explained as follows.

First of all, when the door is closed after the laundry has been put in the dryer, the hanging portion 73 of the hook 71 is inserted through the insertion hole 81*a* of the latch assembly 80. As the hanging portion 73 of the hook 71 is inserted, the holder 85 loaded in the latch assembly 80, which is guided by the first incline surface 73*a*, moves backward. Namely, as the hanging portion 73 is inserted, the gap between the first and second holders 85*a* and 85*b* gets widened by the first incline surface 73*a*.

After the insertion of the hanging portion 73, the first and second holders 85*a* and 85*b* return to their original positions by the elasticity of the springs 90 so as to hold to fix the hanging portion 73. Once the door 70 is closed, a drying step of the dryer is executed. Meanwhile, the second incline surface 73*b* of the hanging portion 73 coming into contact with the holder 85 has the predetermined incline angle. When the door is pulled by a certain force, the hanging portion 73 slides out to be released from the holder 85. Thus, the user pulls the door 70 by the certain force to open.

Accordingly, the apparatus for opening/closing the door of the dryer according to the present invention has the following advantages or effects.

First of all, the confronting first and second holders hold the hanging portion of the hook having the triangular cross-section. And, the springs are provided to the rear ends of the first and second holders, whereby the door can be easily opened by being pulled with a certain force. Namely, the user just pulls the door with a predetermined force to open the door conveniently. Therefore, the present invention provides the apparatus for opening/closing the door, by which the user can open the door of the dire in progress in order to put in more objects to be dried or to check a drying state of the laundry.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A dryer comprising:

a housing;

a drum rotatably installed in the housing;

a heating apparatus for supplying hot air to the drum;

a door opening/closing an entrance formed at the housing for putting a laundry in the drum; and an apparatus for opening/closing the door, comprising:

a hook provided at one side of the door of the dryer, the hook having a hanging portion formed at one end to have an incline surface;

a latch body provided to the housing in the vicinity of the entrance wherein the hanging portion is inserted into the latch body;

a pair of holders provided to confront each other in the latch body to hold the hanging portion; and a pair of springs provided at a rear of the holders, respectively, wherein the latch body comprises a first reception part receiving the hanging portion; and a pair of second reception parts provided adjacent to both sides of the first reception part to hold and guide the holders, respectively, and wherein a pair of passing holes communicating with the second reception parts are formed at both of the sides of the first reception part to let the holders pass through, respectively.

2. The dryer as claimed in claim 1, wherein a recess is formed at one end of each of the second reception parts to support the corresponding spring.

3. The dryer as claimed in claim 1, wherein a hanging protrusion is formed on one side of each of the holders to be held by an upper end of the first reception part.

4. The dryer as claimed in claim 1, wherein the hanging portion has a triangular cross-section.

5. The dryer as claimed in claim 4, wherein confronting planes of the holders are inclined to correspond to the triangular cross-section of the hanging portion.

6. The dryer as claimed in claim 1, wherein a surface of the hanging portion to be brought into contact with the holders is rounded.

7. The dryer as claimed in claim 6, wherein two confronting tips of the holders are rounded.

8. The dryer as claimed in claim 1, wherein a hollow portion is provided at a rear side of each of the holders to have one end of the corresponding spring inserted therein.

9. The dryer as claimed in claim 1, further comprising a latch cap covering the first and second reception parts to prevent separation of the holders and the springs.

10. The dryer as claimed in claim 9, wherein fixing protrusions protrude from a bottom of the latch cap to hold one ends of the springs, respectively.

11. The dryer as claimed in claim 9, wherein guide protrusions protrude from a bottom of the latch cap to guide the moving holders, respectively.

12. The dryer as claimed in claim 9, wherein coupling holes are formed at corners of the latch cap and wherein bolts are screwed in the coupling holes, respectively to fix the latch cap to the latch body.

13. The dryer as claimed in claim 1, wherein the hook is built in one body of a fixing plate screw-coupled to one side of the door.

14. The dryer as claimed in claim 1, wherein coupling holes are formed at both sides of the latch body and wherein bolts are screwed in the coupling holes, respectively to fix the latch body to the front panel.

15. The dryer as claimed in claim 1, wherein an insertion hole is formed in the latch body so that the hanging portion is inserted in the insertion hole.

16. The dryer as claimed in claim 15, wherein the insertion hole comprises an incline surface inclining inward to guide the hanging portion.

17. The dryer as claimed in claim 1, wherein the incline surface guides insertion and separation of the hanging portion.

18. The dryer as claimed in claim 1, wherein the incline surface is provided to open a gap between the holders.

19. The dryer as claimed in claim 1, wherein the incline surface is provided to push the holders backward.

20. The dryer as claimed in claim 1, wherein the incline surface comprises a first incline surface opening a space between the holders to guide an insertion of the hanging portion therein.

21. The dryer as claimed in claim 20, wherein the incline surface comprises a first incline surface that is formed at a front side of the hanging portion.

22. The dryer as claimed in claim 21, wherein the incline surface comprises a second incline surface opening a space between the holders to guide a retreat of the hanging portion.

23. The dryer as claimed in claim 22, wherein the second incline surface is formed at a rear side of the hanging portion.

24. The dryer as claimed in claim 22, wherein the incline surface further comprises an intermediate portion between the first and second incline surfaces to maintain a hanging state of the hanging portion.

25. The dryer as claimed in claim 22, wherein an incline angle of the first incline surface is smaller than that of the second incline surface.

26. The dryer as claimed in claim 1, wherein at least one rib is provided to the hook to reinforce strength thereof.

27. A dryer comprising:

a housing;

a drum rotatably installed in the housing;

a door opening/closing an entrance formed in the housing for putting laundry in the drum; and an apparatus for latching the door, comprising:

a hook provided at one side of the door of the dryer, the hook having a hanging portion formed at one end;

a latch body provided on the housing in the vicinity of the entrance wherein the hanging portion is inserted into the latch body;

a pair of slidable holders provided to confront each other in the latch body and being guided to hold the hanging portion; and a pair of springs provided at least partially inside the holders, respectively, wherein the latch body comprises:

a first reception part receiving the hanging portion; and a pair of second reception parts provided at sides of the first reception part to hold and guide the holders, respectively, and wherein a hanging protrusion is formed on one side of each of the holders, and the hanging protrusion is configured to be blocked by a corresponding protrusion on the first reception part to thereby limit movement of the holders.

28. The dryer as claimed in claim 27, further comprising a latch cap covering the first and second reception parts to prevent separation of the holders and the springs.

29. The dryer as claimed in claim 28, wherein fixing protrusions protrude from a bottom of the latch cap to hold ends of the springs, respectively.

30. The dryer as claimed in claim 28, wherein guide protrusions protrude from a bottom of the latch cap to guide movement of the holders, respectively.

31. The dryer as claimed in claim 28, wherein coupling holes are formed at corners of the latch cap and wherein bolts are screwed in the coupling holes, respectively to fix the latch cap to the latch body.

* * * * *